US008225734B2

(12) United States Patent
Huizenga

(10) Patent No.: US 8,225,734 B2
(45) Date of Patent: Jul. 24, 2012

(54) METHOD FOR BEACHING A BOAT

(76) Inventor: John Charles Huizenga, Holland, MI (US)

( * ) Notice: Subject to any disclaimer, the term of this patent is extended or adjusted under 35 U.S.C. 154(b) by 2240 days.

(21) Appl. No.: 10/973,636

(22) Filed: Oct. 26, 2004

(65) Prior Publication Data

US 2007/0068440 A1 Mar. 29, 2007

(51) Int. Cl.
*B63B 59/02* (2006.01)

(52) U.S. Cl. ..... 114/220; 114/230.1; 405/1

(58) Field of Classification Search ..... 114/219, 114/220, 230.1; 405/2, 4, 6, 1, 3, 5, 7
See application file for complete search history.

(56) References Cited

U.S. PATENT DOCUMENTS

| | | | | |
|---|---|---|---|---|
| 2,754,017 | A * | 7/1956 | Hart et al. | 405/1 |
| 3,977,030 | A * | 8/1976 | Ringdal | 114/375 |
| 4,343,258 | A | 8/1982 | Belvedere | |
| 5,013,272 | A | 5/1991 | Watkins | |
| 5,357,890 | A | 10/1994 | Mason, Jr. et al. | |
| 5,398,631 | A | 3/1995 | Miller | |
| 5,441,006 | A | 8/1995 | Wood | |
| 5,454,341 | A | 10/1995 | Bensley et al. | |
| 5,477,802 | A | 12/1995 | Laue | |
| 5,487,349 | A | 1/1996 | Andreassen | |
| 5,577,455 | A | 11/1996 | Dvorak | |
| 5,628,270 | A | 5/1997 | Ryll et al. | |
| 6,453,837 | B1 | 9/2002 | Arbaugh et al. | |
| 6,637,360 | B2 | 10/2003 | Vretta | |
| 2005/0260036 | A1 * | 11/2005 | Emond | 405/1 |

OTHER PUBLICATIONS www.nuovarade.com

* cited by examiner

*Primary Examiner* — Lars A Olson
(74) *Attorney, Agent, or Firm* — Timothy S. Stevens

(57) ABSTRACT

A method for beaching a boat that includes four steps. The first step is to attach one end of a boat fender to one end of another boat fender to form a roller assembly. The second step is to position the roller assembly near and parallel to a shoreline of a body of water. The third step is to position a boat in the water and perpendicular to the shoreline with the center of the bow of the boat centered at the center of the roller assembly. The fourth step is to move the boat toward and onto land, the boat rolling on the roller assembly. In addition, an article of manufacture and an apparatus for joining boat fenders together to form such a roller assembly. The boat can be stowed on the roller assemblies and can be launched back into the water by reversing the method.

6 Claims, 12 Drawing Sheets

METHOD FOR BEACHING A BOAT

BACKGROUND

The instant invention relates to methods and apparatus for beaching a boat. More specifically, the instant invention relates to methods and apparatus for beaching a boat by rolling the boat onto shore on an assembly of boat fenders.

Beaching a small boat, such as a recreational sail boat, a canoe, a kayak, a small motor boat, a personal watercraft, a jet boat or a row boat, usually subjects the boat to minor damage from abrasion as the boat is dragged up onto shore and can require a significant amount of effort. Nuova Rade spa of Italy (nuovarade.com/boat-fenders.htm) offers a cylindrical boat fender to be positioned parallel to a shoreline of a body of water so that a boat in the water and perpendicular to the shoreline with the center of the bow of the boat centered near the center of the fender can be moved toward and onto land by rolling the boat on the fender. However, the boat fender offered by Nuova Rade is significantly longer than an ordinary boat fender and thus is of reduced use as a boat fender for a small boat. In addition, the boat fender offered by Nuova Rade does not align the keel of the boat with the fender as the boat is rolled onto land. Therefore, the boat can roll off the side of the fender as the boat is rolled onto land.

SUMMARY OF THE INVENTION

The instant invention, in a sense, is an improvement on the method and apparatus suggested and offered by Nuova Rade. Unlike the method suggested by Nuova Rade, the method of the instant invention can make use of standard length boat fenders and the method of the instant invention tends to align the keel of the boat with an assembly of boat fenders at the position where two boat fenders are joined.

More specifically, the instant invention is a method for beaching a boat, comprising four steps. The first step is to attach one end of a first boat fender to one end of a second boat fender to form a first roller assembly. The second step is to position the first roller assembly near and substantially parallel to a shoreline of a body of water. The third step is to position a boat in the water and substantially perpendicular to the shoreline with the center of the bow of the boat substantially centered at the center of the first roller assembly. The fourth step is to move the boat toward and onto land, the boat rolling on the first roller assembly. Preferably, two or more such assemblies are used. The Boat can be stowed on the assemblies and then launched back into the water by reversing the steps of the method of the instant invention.

In another embodiment, the instant invention is an article of manufacture useful for attaching an eyelet end of a first boat fender having an eyelet end to an eyelet end of a second boat fender having an eyelet end, comprising: a panel, the panel having a centerline, the panel comprising two spaced apart apertures therethrough on one side of the centerline and two spaced apart apertures therethrough on the other side of the centerline, the material of construction of the panel at the centerline being sufficiently flexible and the position of the apertures being such that when the panel is folded along the centerline, the apertures on one side of the centerline align with the apertures on the other side of the centerline.

In a related embodiment, the instant invention is an article of manufacture useful for attaching an eyelet end of a first boat fender having an eyelet end to an eyelet end of a second boat fender having an eyelet end, comprising: a panel, the panel having a centerline, the panel comprising two spaced apart apertures therethrough on one side of the centerline and two spaced apart projections therefrom on the other side of the centerline, the material of construction of the panel at the centerline being sufficiently flexible and the position and dimensions of the apertures and projections being such that when the panel is folded along the centerline, the apertures on one side of the centerline align with the projections on the other side of the centerline so that the projections pass through the apertures with an interference fit.

In another embodiment the instant invention is an apparatus useful for attaching an eyelet end of a first boat fender having an eyelet end to an eyelet end of a second boat fender having an eyelet end, comprising: a first hemi-cylindrical section joined to a second hemi-cylindrical section by a hinge pin, the first section comprising two spaced apart apertures therethrough, the second section comprising two spaced apart projections therefrom, the position and dimensions of the apertures and projections being such that when the first section is moved toward the second section the apertures align with the projections so that the projections pass through the apertures with an interference fit.

DETAILED DESCRIPTION OF THE INVENTION

Figure 1:
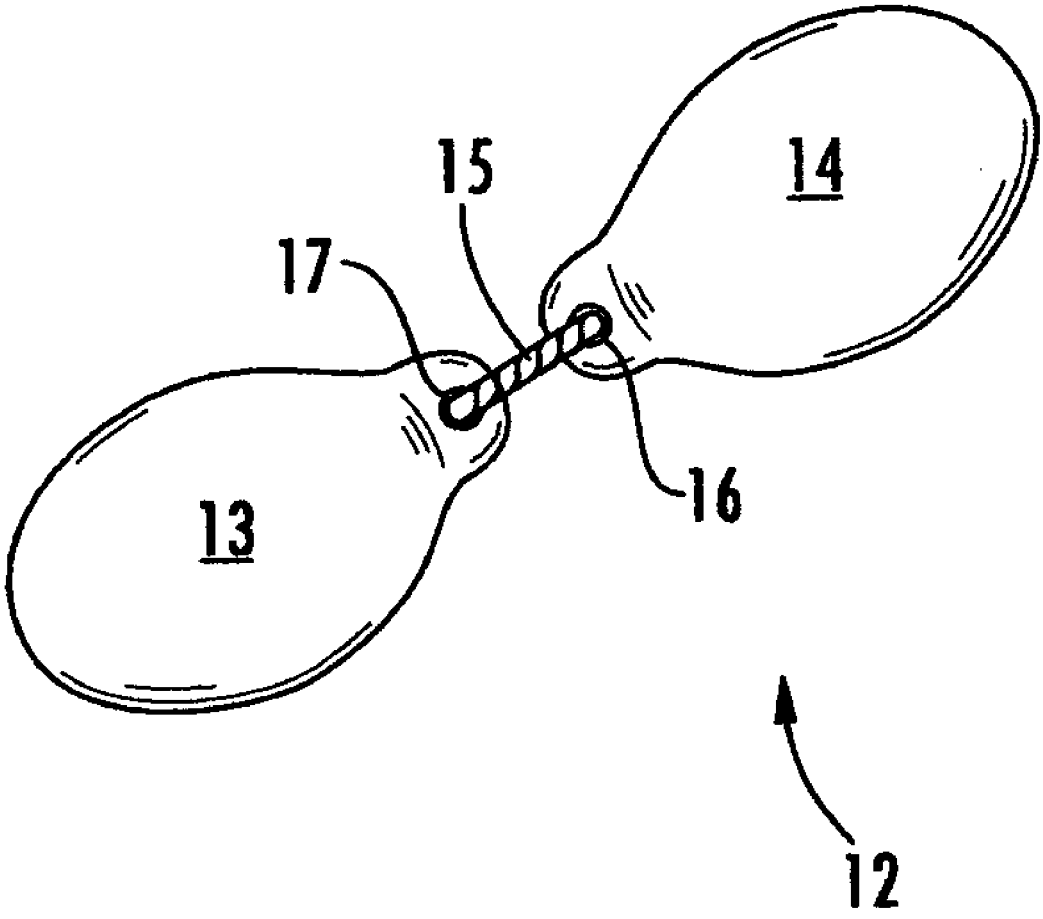
FIG. 1 shows a roller assembly for use in the method of the instant invention consisting of two pear-shaped boat fenders attached to each other by a length of rope.

Referring now to FIG. 1, therein is shown a roller assembly 11 for use in the method of the instant invention. The roller assembly 11 consists of a first pear-shaped boat fender 12 attached to a second pear-shaped boat fender 13 by way of a length of rope 14. The rope 14 is shown passing through the eyelets 16 and 17 of the fenders 13 and 14 respectively.

Figure 2:
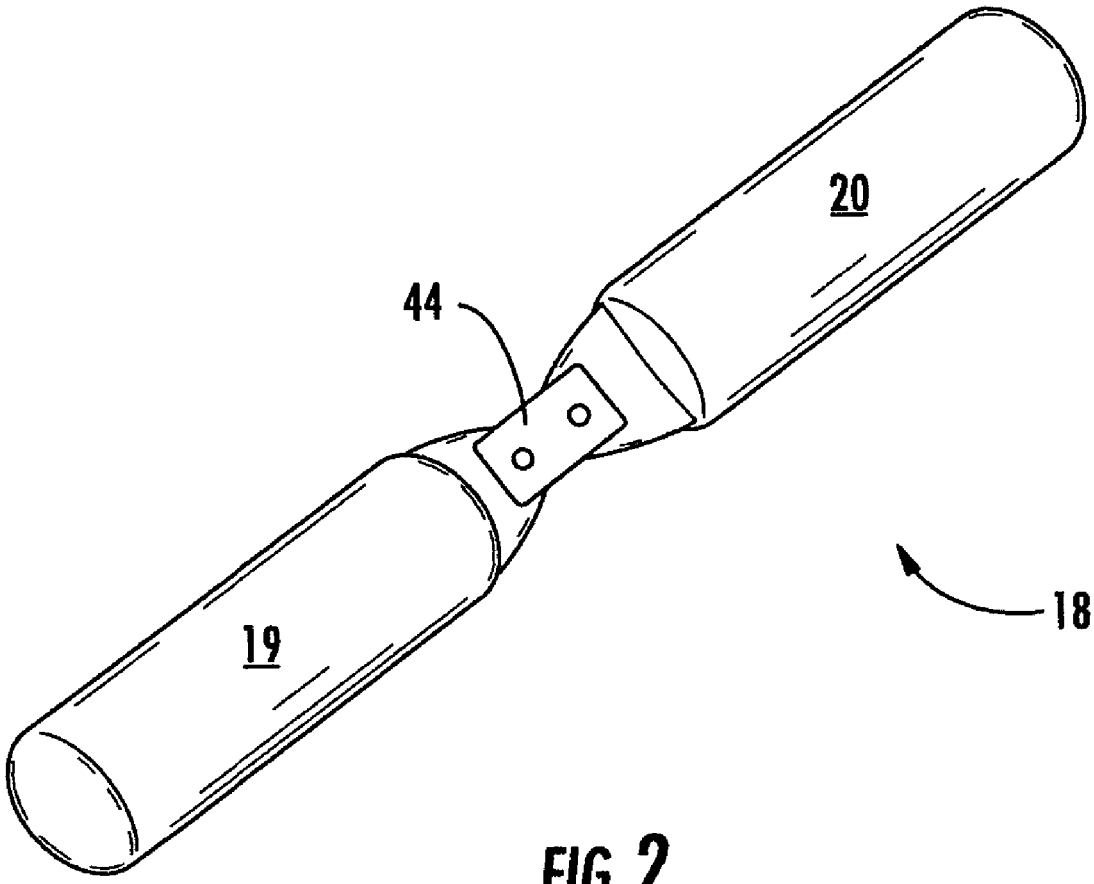
FIG. 2 shows a roller assembly for use in the method of the instant invention consisting of two cylindrically shaped boat fenders attached to each other by a perforated, folded panel.

Referring now to FIG. 2, therein is shown another roller assembly 18 for use in the method of the instant invention. The roller assembly 18 consists of a first cylindrical boat fender 19 attached to a second cylindrical boat fender 20 by way of a folded panel 21. The folded panel 21 will be discussed below in greater detail.

Figure 3:
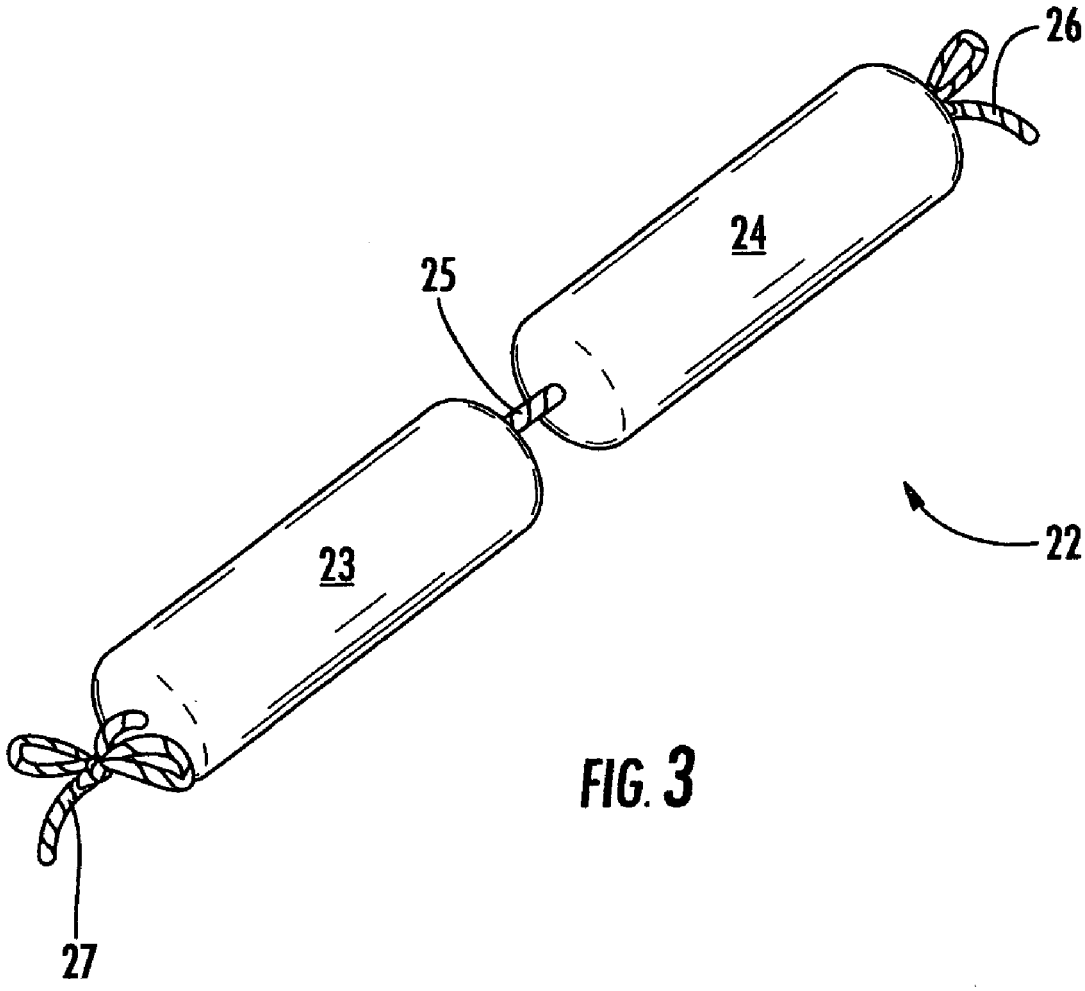
FIG. 3 shows a roller assembly for use in the method of the instant invention consisting of two hollow core, cylindrically shaped boat fenders attached to each other by a length of rope.

Referring now to FIG. 3, therein is shown a roller assembly 22 for use in the method of the instant invention. The roller assembly 22 consists of a first cylindrical boat fender 23 attached to a second cylindrical boat fender 24 by way of a length of rope 25. The rope 25 is shown passing through the open core channel the fenders 23 and 24 and tied in a first knot 26 at one end thereof and a second knot 27 at the other end thereof.

Figure 4:
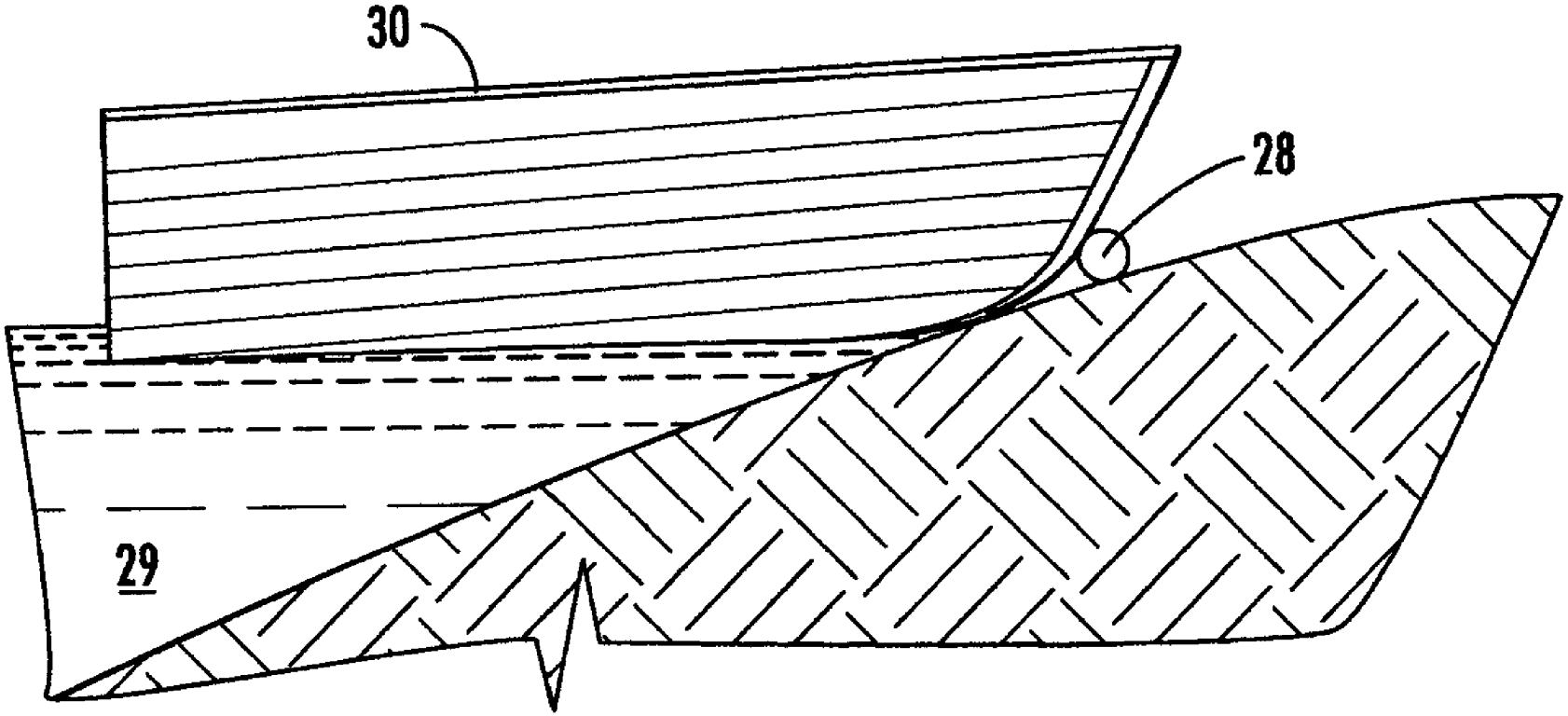
FIG. 4 shows a boat with its bow at the shoreline and aligned with a roller assembly.
Figure 5:
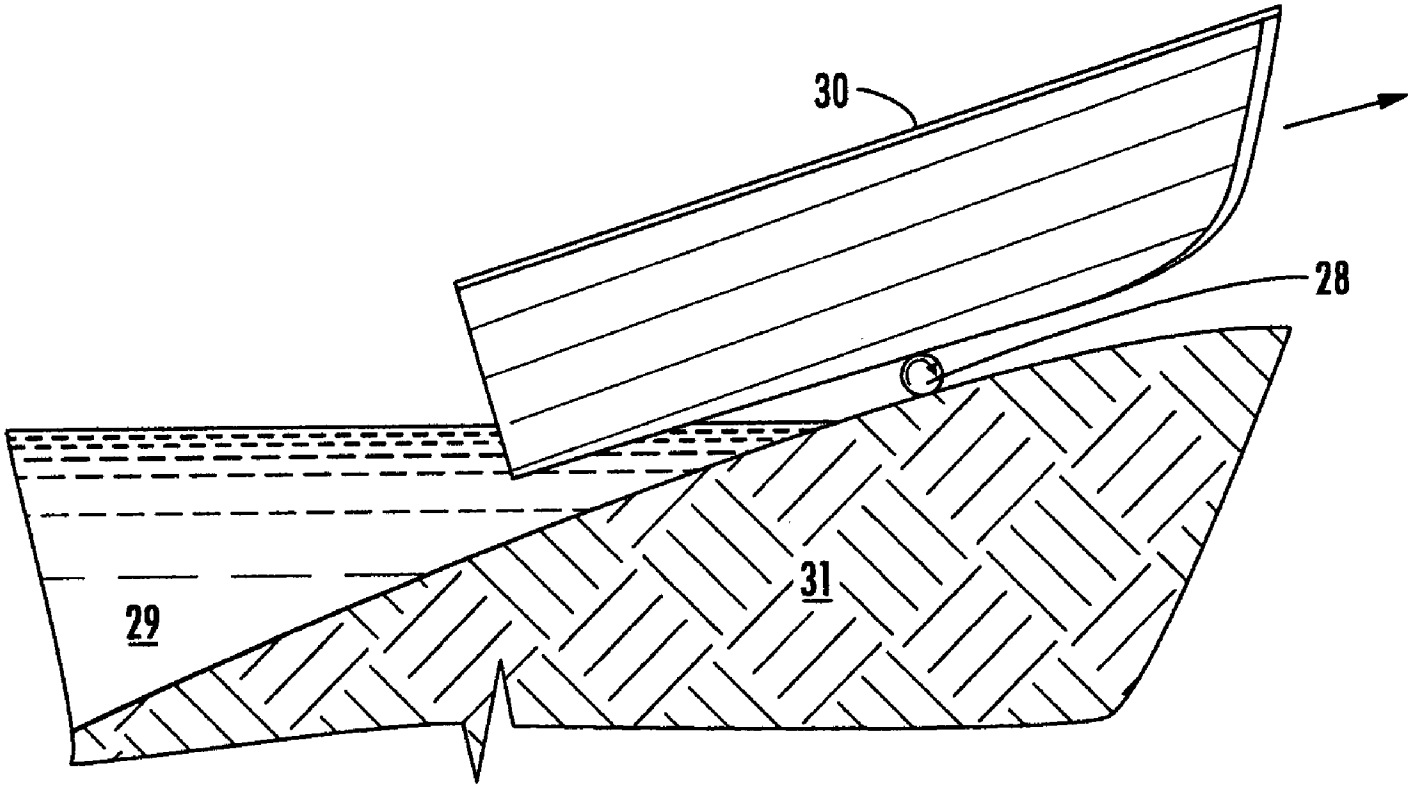
FIG. 5 shows the boat of FIG. 4 being rolled onto land.

Referring now to FIG. 4, therein is shown a roller assembly 28 according to the instant invention near and substantially parallel to a shoreline of a body of water 29 and a boat 30 in the water 29 and substantially perpendicular to the shoreline with the center of the bow of the boat 30 substantially centered at the center of the roller assembly 28. Referring now to FIG. 5, therein is shown the boat 30 moving toward and onto land 31, the boat 30 rolling on the assembly 28.

Figure 6:
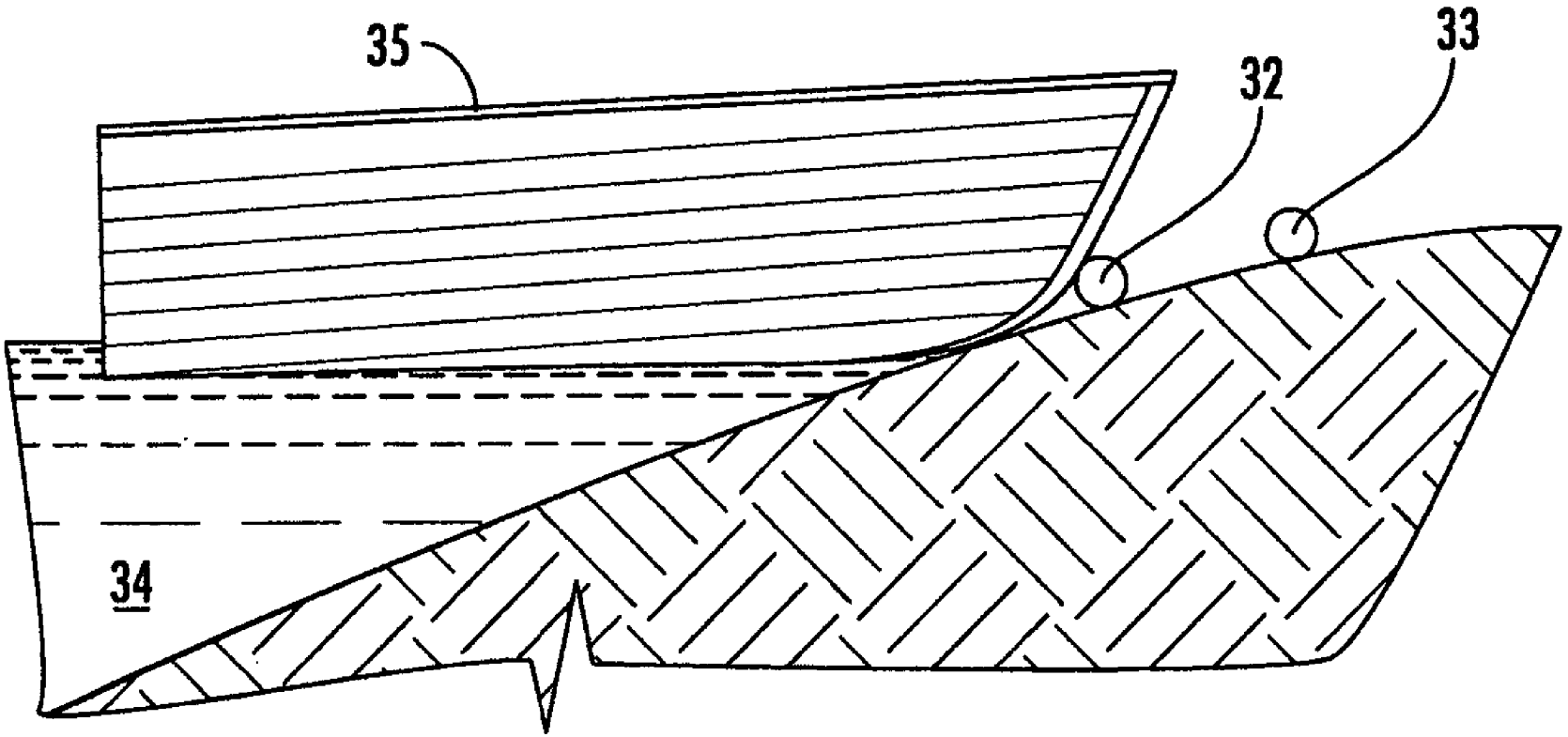
FIG. 6 a boat with its bow at the shoreline and aligned with two roller assemblies.
Figure 7:
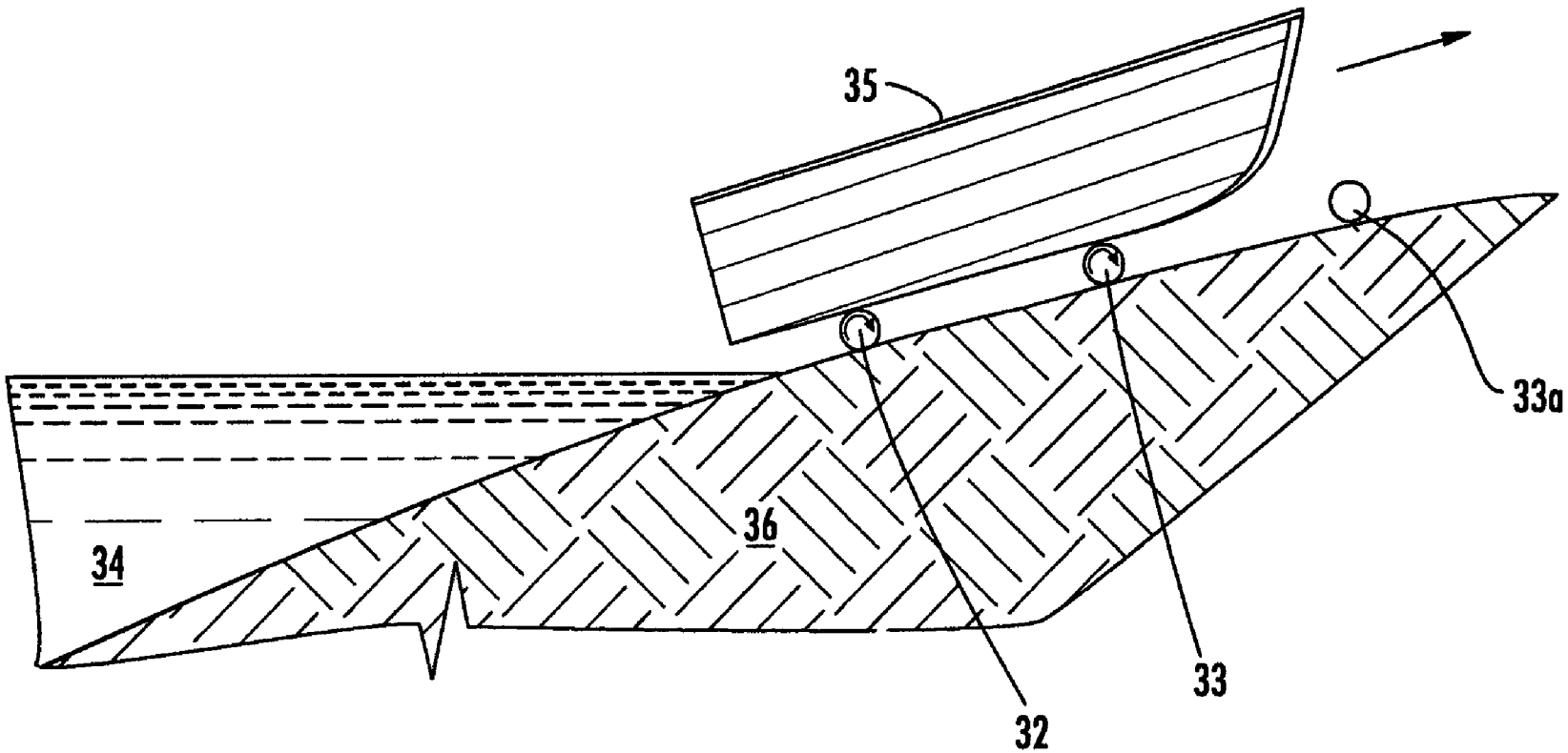
FIG. 7 shows the boat of FIG. 6 being rolled onto land.

Referring now to FIG. 6, therein is shown a pair of roller assemblies 32 and 33 according to the instant invention near and substantially parallel to a shoreline of a body of water 34 and a boat 35 in the water 34 and substantially perpendicular to the shoreline with the center of the bow of the boat 35 substantially centered at the center of the assembly 32. Referring now to FIG. 7, therein is shown the boat 35 moving toward and onto land 36, the boat 35 rolling on the assemblies 32 and 33. A third assembly 33*a* is preferably positioned ahead of the boat 35 so that when the boat 35 is moved onto the assemblies 33 and 33*a*, then assembly 32 can be repositioned ahead of the boat so that the boat is always supported by two assemblies as it is moved further onto the land 36. A winch, not shown, may be used to aid in the movement of the boat.

Figure 11:
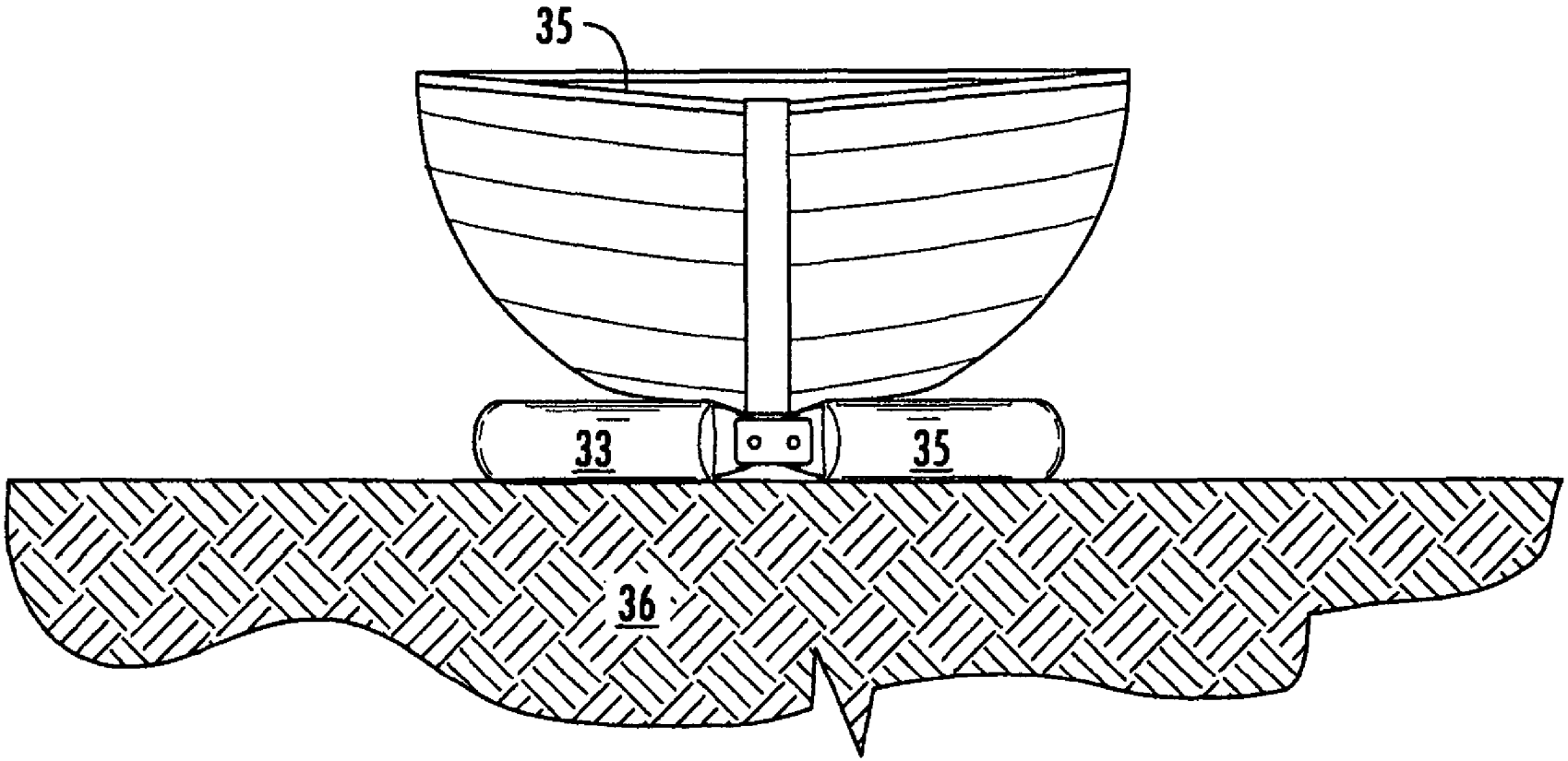
FIG. 11 shows a front view of a boat being rolled onto land using an assembly of boat fenders of the instant invention.

Referring now to FIG. 11, therein is shown a front view of the boat 35 being rolled onto land 36 using the assembly of boat fenders 33 of the instant invention. The assemblies of the instant invention can be used to conveniently stow a boat by leaving the boat on two or more assemblies and, of course, can then be used to launch the boat by reversing the steps of the method of the instant invention.

Figure 8:
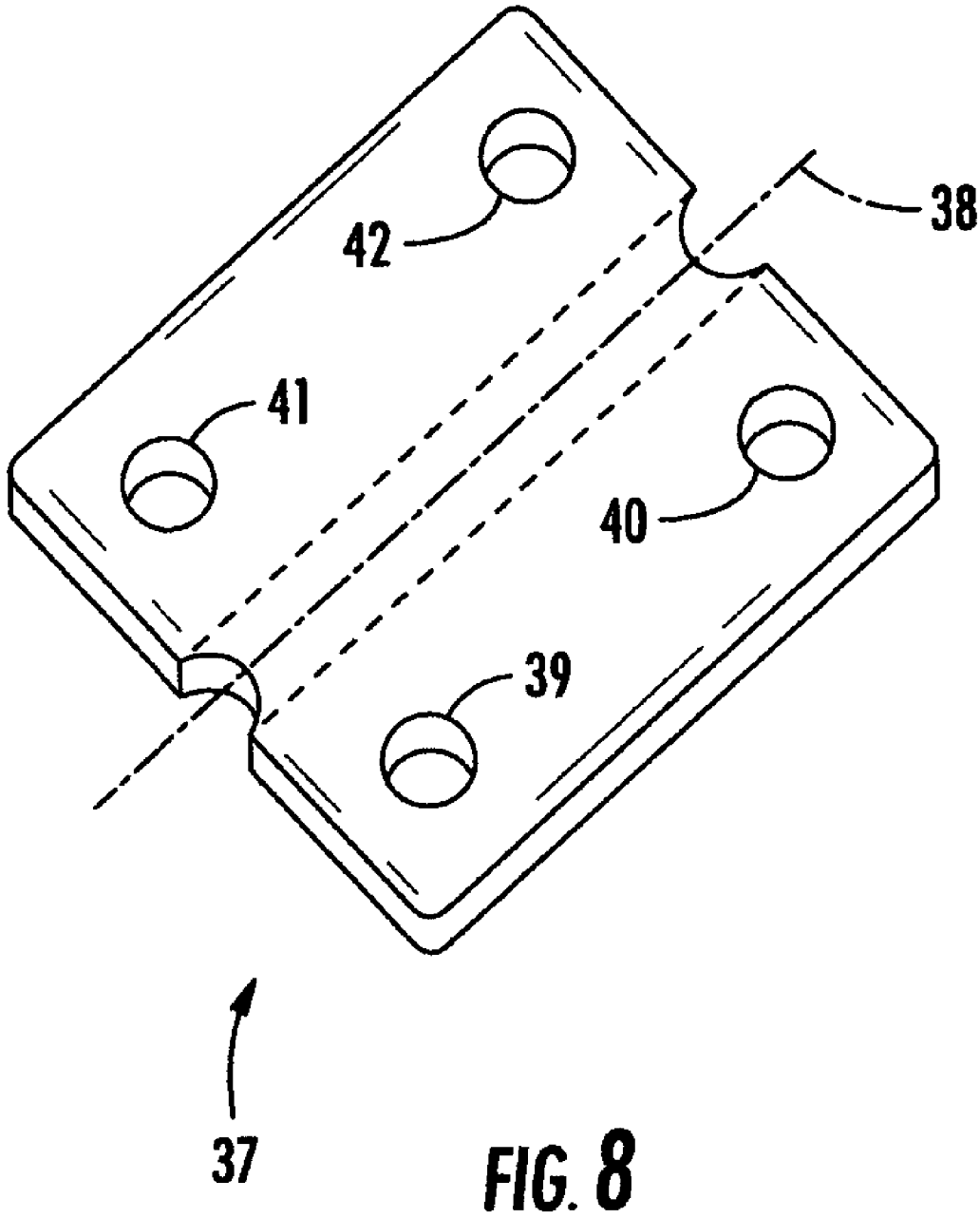
FIG. 8 shows a flexible panel of the instant invention having perforations therethrough.

Referring now to FIG. 8, therein is shown an article of manufacture 37 of the instant invention that is useful for attaching an eyelet end of a first boat fender having an eyelet end to an eyelet end of a second boat fender having an eyelet end. The article 37 has a centerline 38. The article 37 also comprises two spaced apart apertures therethrough 39 and 40 on one side of the centerline 38 and two spaced apart apertures therethrough 41 and 42 on the other side of the centerline 38. The material of construction of the article 37 at the centerline 38 needs to be sufficiently flexible so that the article 37 can be folded along the centerline. Preferably, the material of construction of the article 37 is plasticized polyvinyl chloride of essentially the same formulation as is used to make boat fenders. In addition, the position of the apertures 40 and 42, and 39 and 41 needs to be such that when the article 37 is folded along the centerline 38, then the apertures 39 and 40 on one side of the centerline 38 align with the apertures 41 and 42, respectively, on the other side of the centerline 38 so that fasteners or rope can be passed through the apertures to secure the fenders.

Figure 9:
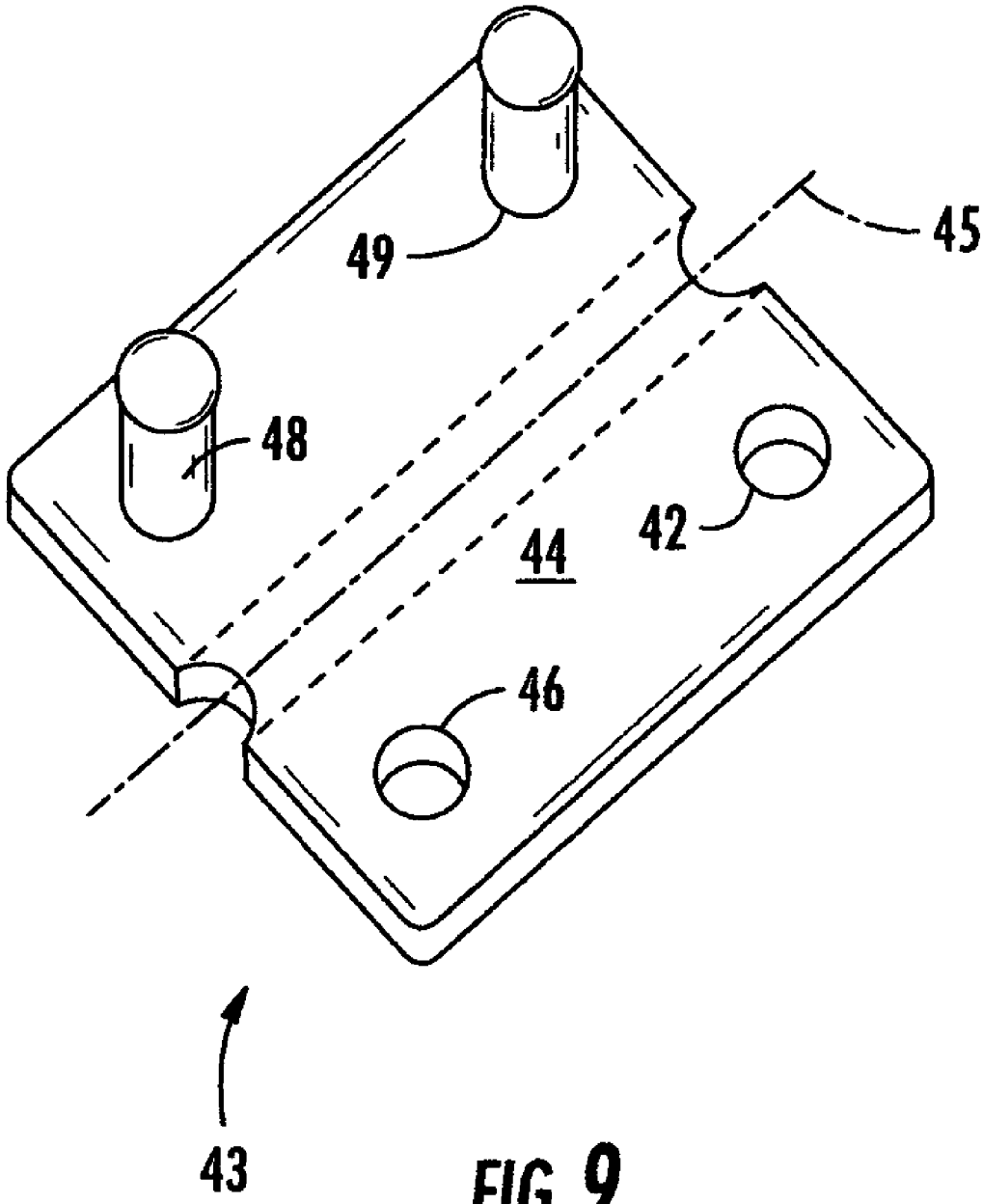
FIG. 9 shows a flexible panel of the instant invention having perforations therethrough and projections therefrom.

Referring now to FIG. 9, therein is shown another article of manufacture 43 of the instant invention that is useful for attaching an eyelet end of a first boat fender having an eyelet end to an eyelet end of a second boat fender having an eyelet end. The article 43 comprises a panel 44 having a centerline 45. The panel 44 also comprises two spaced apart apertures 46 and 47 therethrough on one side of the centerline 45 and two spaced apart projections 48 and 49 therefrom on the other side of the centerline 45. The material of construction of the panel 44 at the centerline 45 needs to be sufficiently flexible and the position and dimensions of the apertures 46 and 47 as well as the position and dimensions of the projections 48 and 49 such that when the panel 44 is folded along the centerline 45, the apertures 46 and 47 on one side of the centerline 45 align with the projections 48 and 49 on the other side of the centerline 45 so that the projections 48 and 49 pass through the apertures 46 and 47 with an interference fit. Preferably, the material of construction of the article panel 44 is plasticized polyvinyl chloride of essentially the same formulation as is used to make boat fenders.

Figure 10:
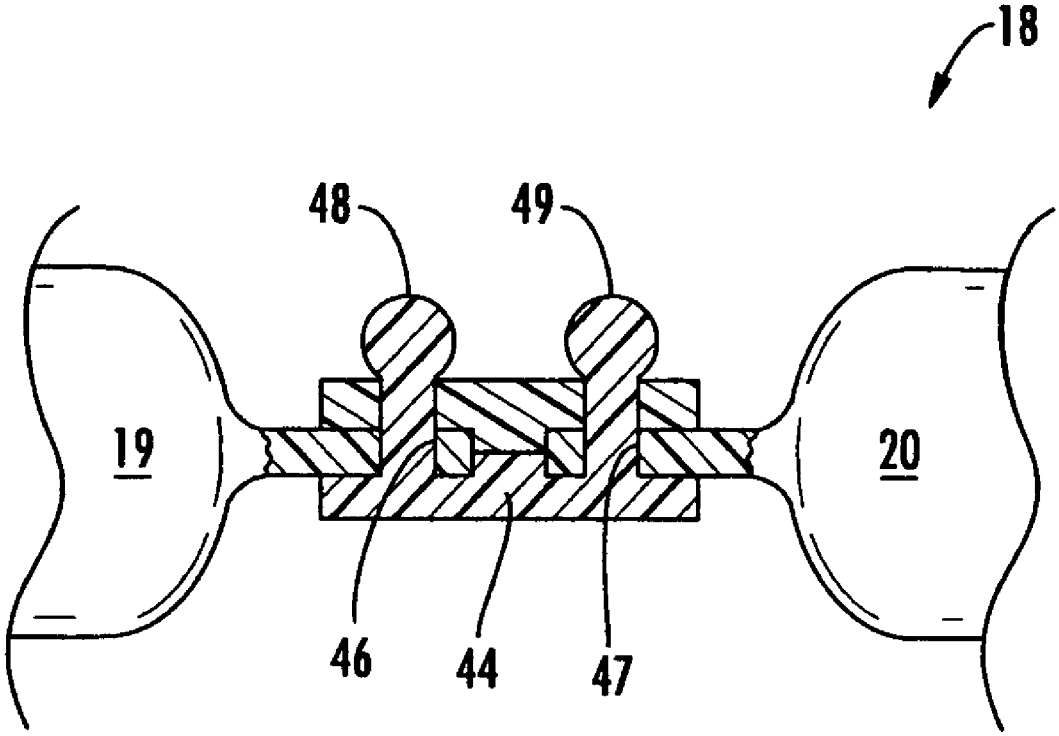
FIG. 10 shows the central portion of the assembly of FIG. 2 in greater detail, part in full and part in cross section.

Referring now to FIG. 10, therein is shown the central portion of the assembly 18 of FIG. 2 in greater detail, part in full and part in cross section. The assembly 18 comprises the panel 44 of FIG. 9 folded so that the projections 48 and 49 have passed through the apertures 46 and 47 with an interference fit provided by the bulbous ends of the projections 48 and 49. When desired, the panel 44 shown in FIG. 10 can be unfolded to free the fenders 19 and 20 so that they can be used, if desired, as boat fenders.

Figure 12:
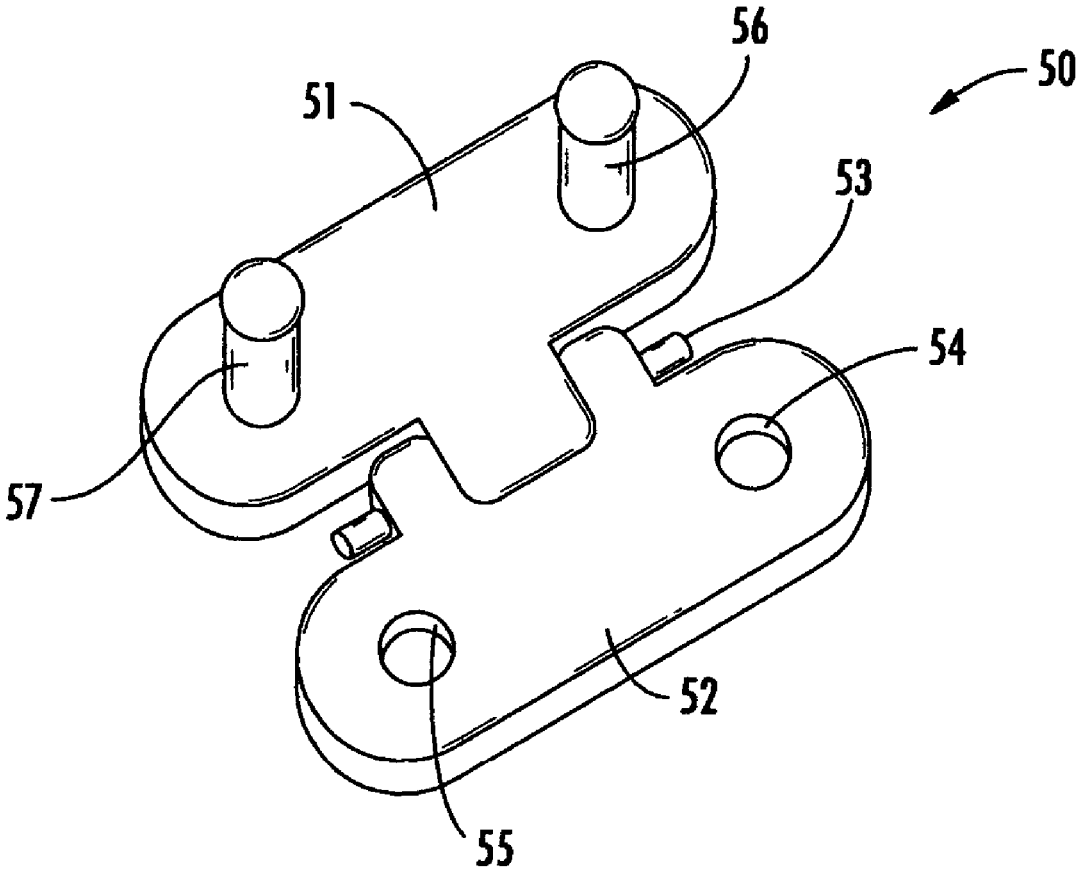
FIG. 12 shows a hinged apparatus of the instant invention for joining boat fenders.

Referring now to FIG. 12, therein is shown apparatus 50 of the instant invention that is useful for attaching an eyelet end of a first boat fender having an eyelet end to an eyelet end of a second boat fender having an eyelet end. The apparatus 50 comprises a first hemi-cylindrical section 51 hinged to a second hemi-cylindrical section 52 by a hinge pin 53. The second section 52 comprises two spaced apart apertures 54 and 55 therethrough. The first section 51 comprises two spaced apart projections 56 and 57 therefrom. The position and dimensions of the apertures 54 and 55 as well as the position and dimensions of the projections 56 and 57 are such that when the section 51 is hinged toward the section 52, the apertures 54 and 55 align with the projections 56 and 57 so that the projections 56 and 57 pass through the apertures 54 and 55 with an interference fit provided by the bulbous ends of the projections 56 and 57. When desired the apparatus 50 can be unfolded to free any attached fenders so that they can be used, if desired, as boat fenders. Preferably, the material of construction of the sections 51 and 52 is plasticized polyvinyl chloride of essentially the same formulation as is used to make boat fenders.

The method of the instant invention significantly reduces the effort needed to beach or launch a small boat. The method of the instant invention significantly reduces the scratching and scraping of the bottom of the boat when it is moved onto land or launched into water from land. The articles of manufacture and the apparatus of the instant invention provide a facile means of joining two boat fenders together for use in the method of the instant invention.

In conclusion, it is readily apparent that although the invention has been described in relation with its preferred embodiments, it should be understood that the instant invention is not limited thereby but is intended to cover all alternatives, modifications and equivalents that are included within the scope of the invention as defined by the following claims.

What is claimed is:

1. An article of manufacture useful for attaching an eyelet end of a first boat fender having an eyelet end to an eyelet end of a second boat fender having an eyelet end, comprising: a panel, the panel having a centerline, the panel comprising two spaced apart apertures therethrough on one side of the centerline and two spaced apart apertures therethrough on the other side of the centerline, the material of construction of the panel at the centerline being sufficiently flexible and the position of the apertures being such that when the panel is folded along the centerline, the apertures on one side of the centerline align with the apertures on the other side of the centerline.

2. The article of manufacture of claim 1, wherein the material of construction of the panel comprises polyvinyl chloride.

3. An article of manufacture useful for attaching an eyelet end of a first boat fender having an eyelet end to an eyelet end of a second boat fender having an eyelet end, comprising: a panel, the panel having a centerline, the panel comprising two spaced apart apertures therethrough on one side of the centerline and two spaced apart projections therefrom on the other side of the centerline, the material of construction of the panel at the centerline being sufficiently flexible and the position and dimensions of the apertures and projections being such that when the panel is folded along the centerline, the apertures on one side of the centerline align with the projections on the other side of the centerline so that the projections pass through the apertures with an interference fit.

4. The article of manufacture of claim 3, wherein the material of construction of the panel comprises polyvinyl chloride.

5. Apparatus useful for attaching an eyelet end of a first boat fender having an eyelet end to an eyelet end of a second boat fender having an eyelet end, comprising: a first hemi-cylindrical section joined to a second hemi-cylindrical section by a hinge pin, the first section comprising two spaced apart apertures therethrough, the second section comprising two spaced apart projections therefrom, the position and dimensions of the apertures and projections being such that when the first section is moved toward the second section the apertures align with the projections so that the projections pass through the apertures with an interference fit.

6. The apparatus of claim 5, wherein the material of construction of the first and second sections comprises polyvinyl chloride.

* * * * *